US009017085B2

(12) United States Patent
Oshita et al.

(10) Patent No.: US 9,017,085 B2
(45) Date of Patent: Apr. 28, 2015

(54) AUXILIARY FITTING JIG

(71) Applicant: Yazaki Corporation, Minato-ku, Tokyo (JP)

(72) Inventors: Osamu Oshita, Aichi (JP); Naoki Kobayashi, Aichi (JP); Akihiro Tsuruta, Shizuoka (JP); Toshiya Ishikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 60 days.

(21) Appl. No.: 14/022,308

(22) Filed: Sep. 10, 2013

(65) Prior Publication Data

US 2014/0045358 A1 Feb. 13, 2014

Related U.S. Application Data

(63) Continuation of application No. PCT/JP2012/056428, filed on Mar. 13, 2012.

(30) Foreign Application Priority Data

Mar. 15, 2011 (JP) ..... 2011-056720

(51) Int. Cl.
*H01R 13/62* (2006.01)
*H01R 43/26* (2006.01)
*H01R 13/629* (2006.01)

(52) U.S. Cl.
CPC ..... *H01R 43/26* (2013.01); *H01R 13/62938* (2013.01)

(58) Field of Classification Search
USPC ..... 439/157
See application file for complete search history.

(56) References Cited

U.S. PATENT DOCUMENTS

| | | | | |
|---|---|---|---|---|
| 3,177,567 | A | 4/1965 | Gehrman | |
| 6,305,957 | B1 * | 10/2001 | Fink et al. | 439/157 |
| 6,390,835 | B1 * | 5/2002 | Okabe et al. | 439/157 |
| 6,558,176 | B1 * | 5/2003 | Martin et al. | 439/157 |
| 6,595,790 | B1 * | 7/2003 | Bigotto | 439/157 |
| 6,612,854 | B2 * | 9/2003 | Takata | 439/157 |

(Continued)

FOREIGN PATENT DOCUMENTS

| | | | |
|---|---|---|---|
| JP | H5-182739 | A | 7/1993 |
| JP | 2009-187863 | A | 8/2009 |

(Continued)

OTHER PUBLICATIONS

Korean office action letter issued on Aug. 14, 2014.

*Primary Examiner* — Truc Nguyen
(74) *Attorney, Agent, or Firm* — Marvin A. Motsenbocker; Mots Law, PLLC

(57) ABSTRACT

An auxiliary fitting jig used to fit connectors with each other includes displacement movement members movable to be displaced according to a rotational angle of a lever with respect to both side surfaces of a jig body having a connector reception chamber and connector engagement lock portions. The displacement movement members have deformation preventing portions configured to prevent bending deformation of the connector engagement lock portions and deformation allowing portions configure to allow the bending deformation of the connector engagement lock portions.

4 Claims, 15 Drawing Sheets

(56) References Cited

U.S. PATENT DOCUMENTS

| | | | | |
|---|---|---|---|---|
| 2002/0137377 | A1* | 9/2002 | Okabe et al. | 439/157 |
| 2006/0040536 | A1* | 2/2006 | Putnam et al. | 439/157 |
| 2007/0099461 | A1* | 5/2007 | Pittenger et al. | 439/157 |
| 2007/0232100 | A1* | 10/2007 | Tyler | 439/157 |
| 2009/0203240 | A1 | 8/2009 | Matsumura et al. | |
| 2009/0263998 | A1* | 10/2009 | Epe et al. | 439/157 |

FOREIGN PATENT DOCUMENTS

| | | | |
|---|---|---|---|
| JP | 2011-150934 | A | 8/2011 |
| JP | 2011-159574 | A | 8/2011 |
| JP | 2011-258324 | A | 12/2011 |

* cited by examiner 1
11
21a
14a
15a
31
41
21b
14b
15b
51
32c
33b
13b
16b
Xc
Xd
Xe
34
26a
26b
52
E
63
63a
63b
63c

AUXILIARY FITTING JIG

CROSS REFERENCE TO RELATED APPLICATION

This application is a Continuation of PCT Application No. PCT/JP2012/056428, filed on Mar. 13, 2012, and claims the priority of Japanese Patent Application No. 2011-056720, filed on Mar. 15, 2011, the content of both of which is incorporated herein by reference.

BACKGROUND

1. Technical Field

The present invention relates to an auxiliary fitting jig used to fit one connector with another connector.

2. Related Art

Japanese Unexamined Patent application Publication No. 2009-187863 proposes a lever fitting type connector for fitting one connector with the other connector. In the lever fitting type connector, a lever attached to a male connector is rotated to fit a female connector with the male connector.

SUMMARY

However, in the associated lever fitting type connector, there occurs a problem that once the lever is rotated to fit the female connector with the male connector, the lever cannot be used for fitting other connectors.

Even if there is provided a structure in which the lever is used to fit other connectors, when the female connector is obliquely fitted with the male connector, the lever may be removed from the male connector while the fitting of the female connector with the male connector remains incomplete.

An object of the present invention is to provide an auxiliary fitting jig having improved fitting operation accuracy and a high versatility.

An aspect of the present invention is an auxiliary fitting jig used to fit one connector with an another connector, the auxiliary fitting jig including: a lever; a jig body having a connector reception chamber configured to receive the one connector, a pair of connector engagement protrusions provided on both side surfaces of the jig body and being engageable with the one connector received in the connector reception chamber, and a pair of connector engagement lock portions configured to be bent and deformed in a direction opposite to the connector reception chamber with an engagement of the connector engagement protrusions with the one connector being released by fitting of the one connector received in the connector reception chamber with the another connector; and a pair of displacement movement members movable to be displaced with respect to the both side surfaces according to a rotational angle of the lever, the pair of displacement movement members having deformation preventing portions configured to be in contact with the connector engagement lock portions to prevent bending deformation of the connector engagement lock portions, and deformation allowing portions configure to release the connector engagement lock portions from the contact to allow the bending deformation of the connector engagement lock portions. In a process of fitting the one connector received in the connector reception chamber with the another connector along with a rotation of the lever and of releasing the engagement of the pair of connector engagement protrusions with the one connector, the pair of displacement movement members are configured to move in synchronism with the lever from a position where the bending deformation of the pair of connector engagement lock portions is prevented by the deformation preventing portions to a position where the bending deformation is allowed by the deformation allowing portions.

According to the aspect, in the process of fitting the one connector with the another connector and releasing the engagement of the pair of connector engagement protrusions to the connector, the displacement movement members move in synchronism with the lever from the position where the bending deformation of each connector engagement lock portion is prevented by the deformation preventing portions to the position where the bending deformation is allowed by deformation allowing portions.

Thus, in the process of rotating the lever to fit the one connector with the another connector, the deformation preventing portions prevent the bending deformation of the connector engagement lock portions to prevent removal of the auxiliary fitting jig.

When the one connector fits the another connector, the deformation allowing portions allow the bending deformation of the connector engagement lock portions, and therefore, the auxiliary fitting jig is removed from the connector and then can be used for fitting other connectors.

Accordingly, the present invention can provide an auxiliary fitting jig having improved fitting operation accuracy and a high versatility.

The jig body may have a pair of slide grooves slidably supporting the pair of displacement movement members respectively, and the lever may have a pair of lever bodies configured to rotate in a plane along a sliding direction of the pair of displacement movement members.

According to the above constitution, since a pair of the lever bodies is rotated in a plane along the sliding direction of the displacement movement members, the bending deformation of the connector engagement lock portions can be prevented and allowed with a simple structure.

The lever may have a pair of assembly bosses for the pair of displacement movement members to be assembled on the pair of assembly bosses, and each of the pair of displacement movement members may have a boss attachment hole for the corresponding assembly boss to be movable in the boss attachment hole according to a rotational range of the lever with respect to the jig body.

According to the above constitution, since each of the displacement movement members has the boss attachment hole through which the corresponding assembly boss can move according to the rotational range of the lever, the displacement movement members can be moved with the rotation of the lever.

BRIEF DESCRIPTION OF DRAWINGS

FIGS. 10A and 10B are plan views, FIG. 10C is an Xc-Xc line cross-sectional view of FIG. 10B, FIG. 10D is an Xd-Xd line cross-sectional view of FIG. 10A, and FIG. 10E is an Xe-Xe line cross-sectional view of FIG. 10A.

FIGS. 12A and 12B are front views, FIG. 12C is a XIIc-XIIc line cross-sectional view of FIG. 12B, FIG. 12D is a XIId-XIId line cross-sectional view of FIG. 12A, and FIG. 12E is a XIIe-XIIe line cross-sectional view of FIG. 12A.

FIGS. 15A and 15B are plan views, FIG. 15C is a XVc-XVc line cross-sectional view of FIG. 15B, FIG. 15D is a XVd-XVd line cross-sectional view of FIG. 15A, and FIG. 15E is a XVe-XVe line cross-sectional view of FIG. 15A.

DETAILED DESCRIPTION

Figure 1:
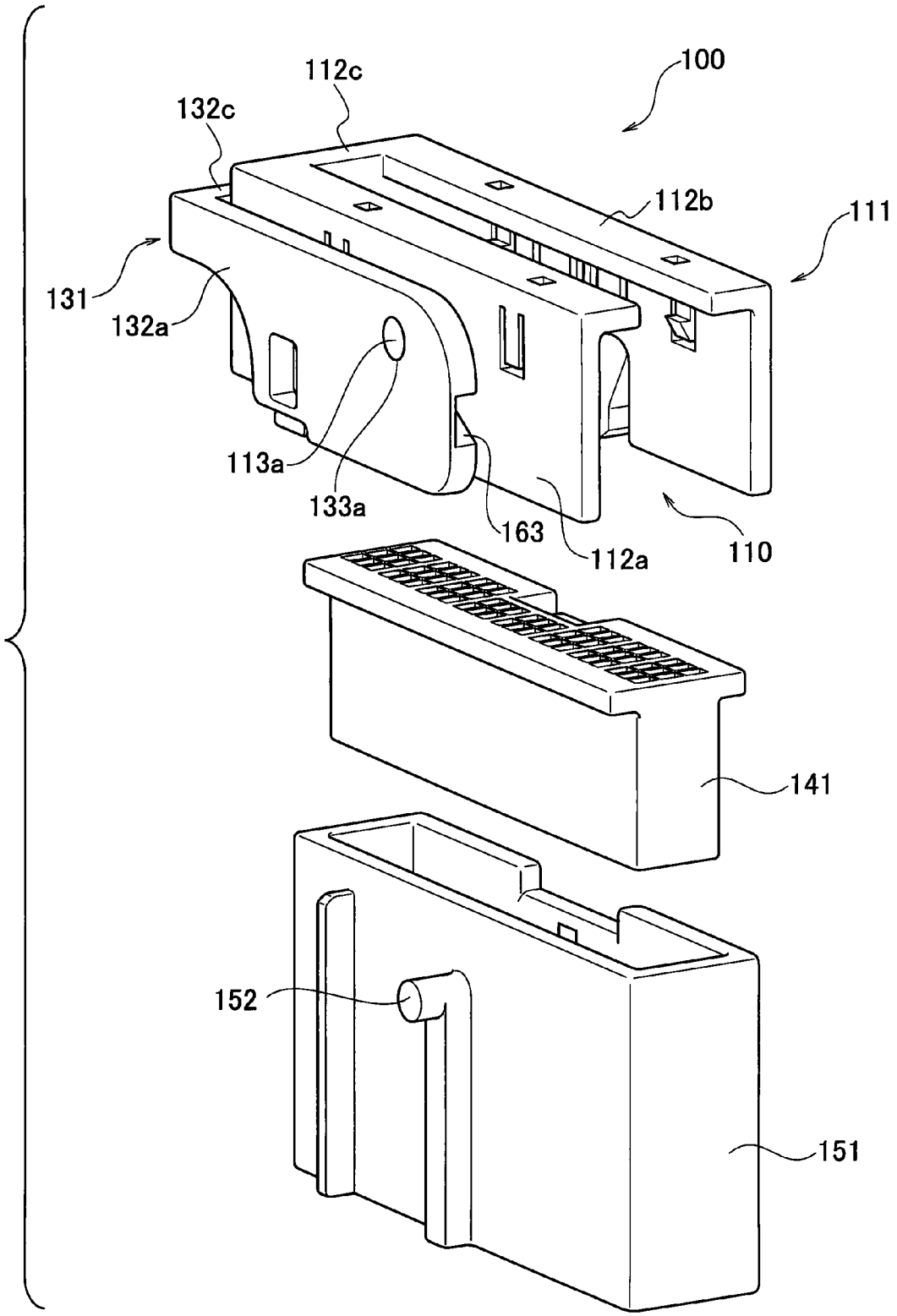
FIG. 1 is a perspective view showing an auxiliary fitting jig, which is a premise of an auxiliary fitting jig of the present invention, and a connector.

Hereinafter, an embodiment of the present invention will be described with reference to the drawings. First, a configuration of an auxiliary fitting jig 100 as a premise of an auxiliary fitting jig of the invention will be described. FIG. 1 is a perspective view showing the auxiliary fitting jig 100, which is the premise of the auxiliary fitting jig of the invention, and connectors 141 and 151.

Figure 2:
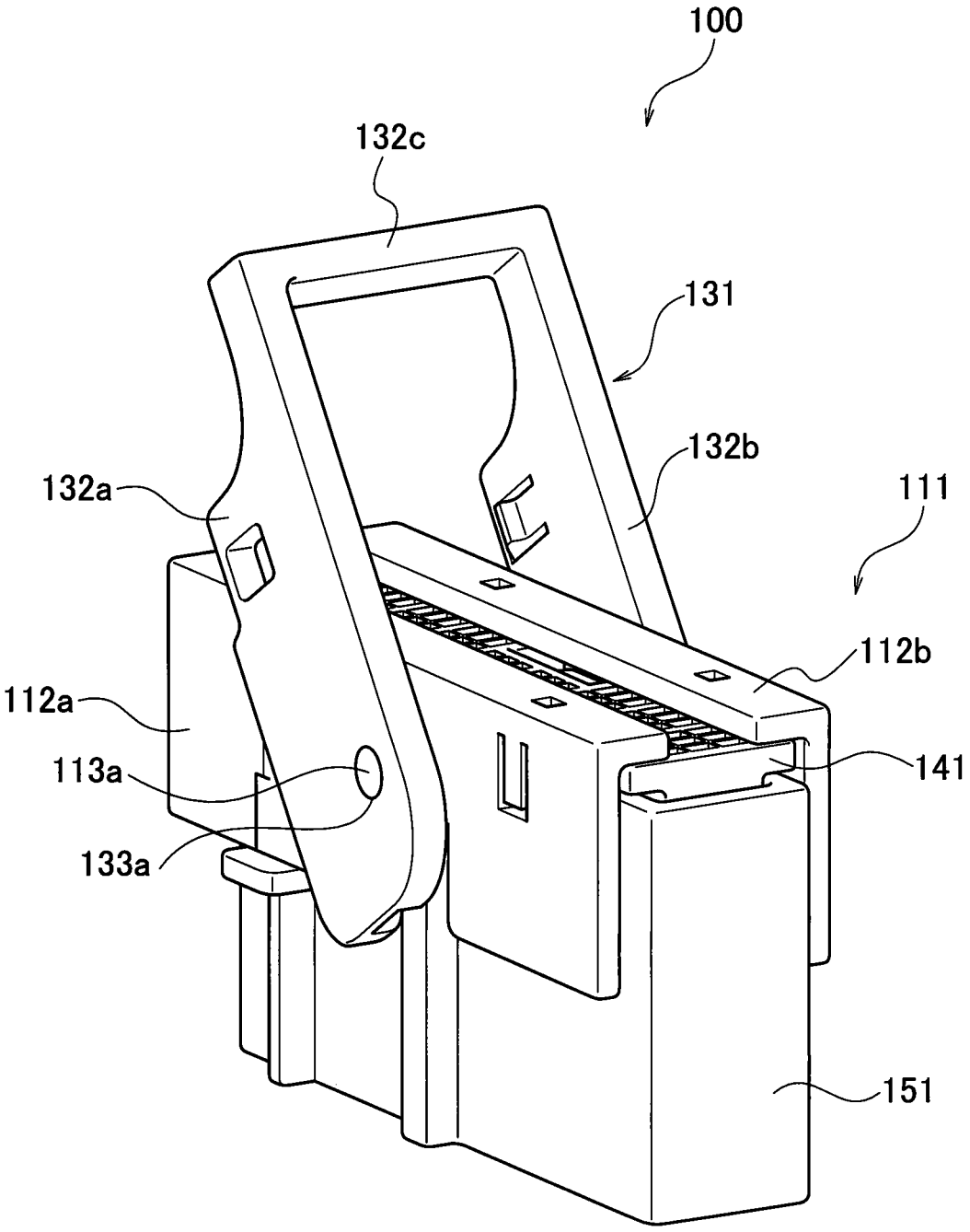
FIG. 2 is a perspective view showing rotation of a lever of the auxiliary fitting jig as the premise of the auxiliary fitting jig of the present invention.
Figure 3:
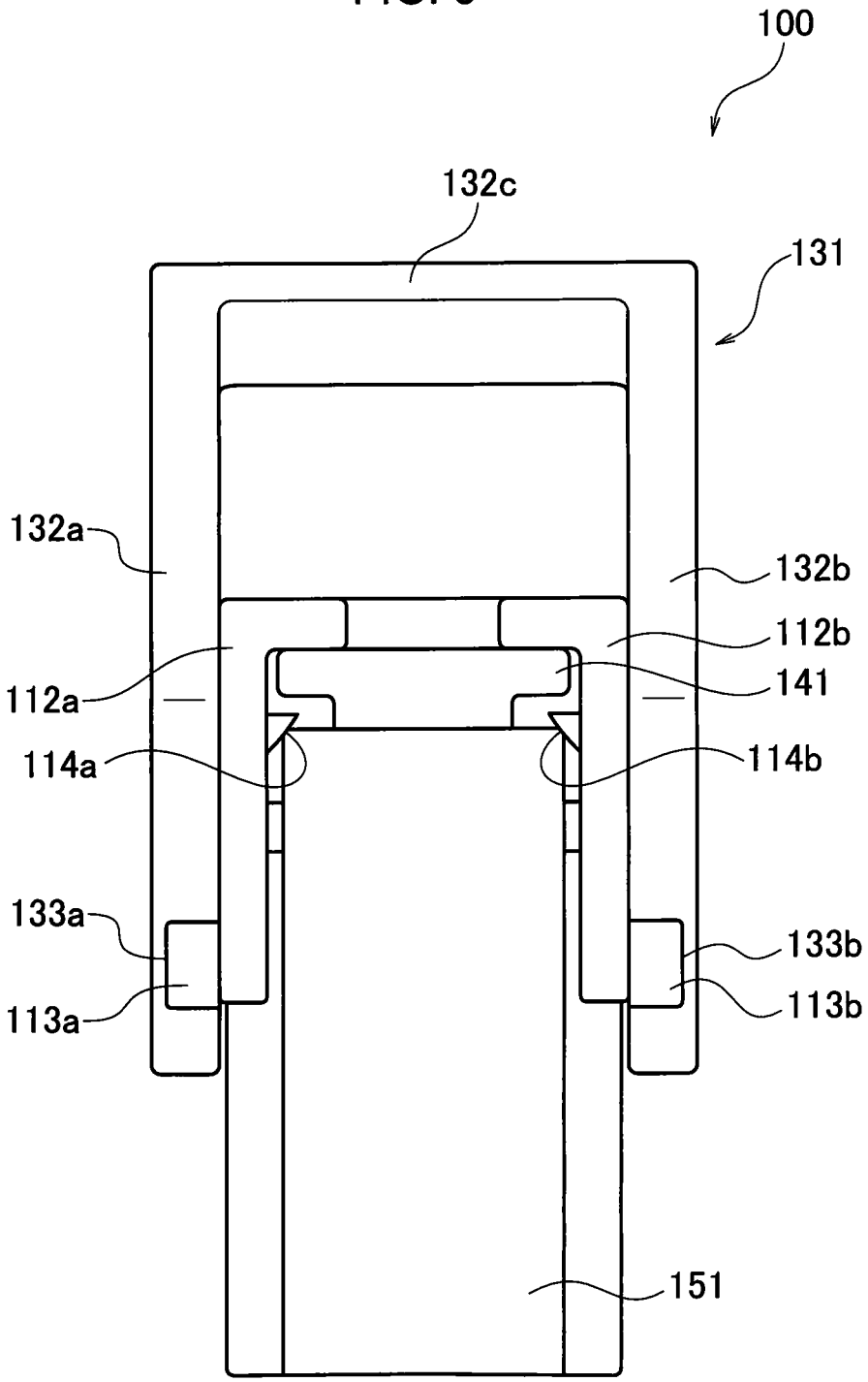
FIG. 3 is a cross-sectional view showing the auxiliary fitting jig as the premise of the auxiliary fitting jig of the present invention.

FIG. 2 is a perspective view showing rotation of a lever 131 of the auxiliary fitting jig 100 as the premise of the auxiliary fitting jig of the invention. FIG. 3 is a cross-sectional view showing the auxiliary fitting jig 100 as the premise of the auxiliary fitting jig of the invention.

The auxiliary fitting jig 100 as the premise of the auxiliary fitting jig of the invention is used for rotating the lever 131 to fit the male connector 151 with the female connector 141.

As illustrated in FIGS. 1 to 3, the auxiliary fitting jig 100 as the premise of the auxiliary fitting jig of the present invention is substantially constituted of a jig body 111 having a connector reception chamber 110 receiving the female connector 141 and the lever 131 rotatably pivotally supported by the jig body 111.

The jig body 111 has a first jig body 112*a* and a second jig body 112*b*, which hold the female connector 141 between them from the both sides of the female connector 141, and a jig body connecting portion 112*c* connecting between the first jig body 112*a* and the second jig body 112*b*.

The first jig body 112*a* and the second jig body 112*b* are provided respectively with lever attachment bosses 113*a* and 113*b* as a pair, which are inserted respectively through jig assembly holes 133*a* and 133*b* to be described later and rotatably pivotally support the lever 131.

The first jig body 112*a* and the second jig body 112*b* are provided respectively with connector engagement protrusions 114*a* and 114*b* as a pair, which are provided on the respective side surfaces of the first and second jig bodies 112*a* and 112*b* and can be engaged with the female connector 141 received in the connector reception chamber 110.

The lever 131 has a first lever body 132*a* rotatably pivotally supported by the first jig body 112*a*, a second lever body 132*b* rotatably pivotally supported by the second jig body 112*b*, and a lever body connecting portion 132*c* connecting between the first lever body 132*a* and the second lever body 132*b*.

The first lever body 132*a* and the second lever body 132*b* have, respectively, jig assembly holes 133*a* and 133*b* as a pair, through which the lever attachment bosses 113*a* and 113*b* as a pair are inserted, respectively.

The first lever body 132*a* and the second lever body 132*b* have a pair of male connector engagement portions 163 (see, FIG. 1, one side is omitted), which engages with a pair of male connector protrusions 152 (see, FIG. 1, one side is omitted) projectingly provided outside the male connector 151, as illustrated in FIG. 1.

When the lever attachment bosses 113*a* and 113*b* are attached to the jig assembly holes 133*a* and 133*b*, the lever 131 is rotatably pivotally supported by the jig body 111.

As illustrated in FIG. 2, in the auxiliary fitting jig 100 in which the lever 131 is attached to the jig body 111, the female connector 141 is received in the connector reception chamber 110 to be inserted into the male connector 151. Then, a male connector protrusion 152 is engaged with the male connector engagement portion 163 from one end (not illustrated) of the male connector engagement portion 163. When the lever 131 is rotated in this state, the male connector 151 fits the female connector 141 accompanying the movement of the male connector protrusion 152 from one end of the male connector engagement portion 163 to the other end illustrated in FIG. 1.

When the male connector 151 and the female connector 141 fit each other, the connector engagement protrusions 114*a* and 114*b* are in contact with the male connector 151 to release the engagement with the female connector 141.

Namely, the male connector 151 enlarges the first and second jig bodies 112*a* and 112*b* toward the first lever body 132*a* or the second lever body 132*b* to release the engagement. At this time, the other end of the male connector engagement portion 163 at which the male connector protrusion 152 is located is in a state of opening downward in the drawing. Accordingly, while the male connector protrusion 152 is removed from the male connector engagement portion 163, the auxiliary fitting jig 100 can release from the female connector 141.

Thus, since the released jig main body 111 and the lever 131 can be used for fitting another female connector and another male connector each other, the auxiliary fitting jig 100 having a high versatility can be realized.

In the auxiliary fitting jig 100, when the male connector 151 is inserted into the connector reception chamber 110 while being tilted with respect to the female connector 141, only the engagement between the connector engagement protrusion 114*a* (or the connector engagement protrusion 114*b*) and the female connector 141 is released by the male connector 151. Namely, the auxiliary fitting jig 100 is in a state in which the engagement between the other connector engagement protrusion 114*b* (or the connector engagement protrusion 114*a*) and the female connector 141 is not released.

In the above state, the male connector protrusion 152 can be removed from the male connector engagement portion 163, and therefore, when the auxiliary fitting jig 100 is to be removed from the male connector 151, an excessive force generated when the female connector 141 is to be removed from the male connector 151 may be applied to the female connector 141.

Thus, in an auxiliary fitting jig 1 according to an embodiment of the present invention, displacement movement members 21*a* and 21*b* which can displacement move with respect to a jig body 11 according to a rotational angle of a lever 31 are provided to thereby prevent release of engagement of the female connector 141 performed by connector engagement protrusions 14*a* and 14*b* in such a state that a female connector 41 does not fit a male connector 51.

Figure 4:
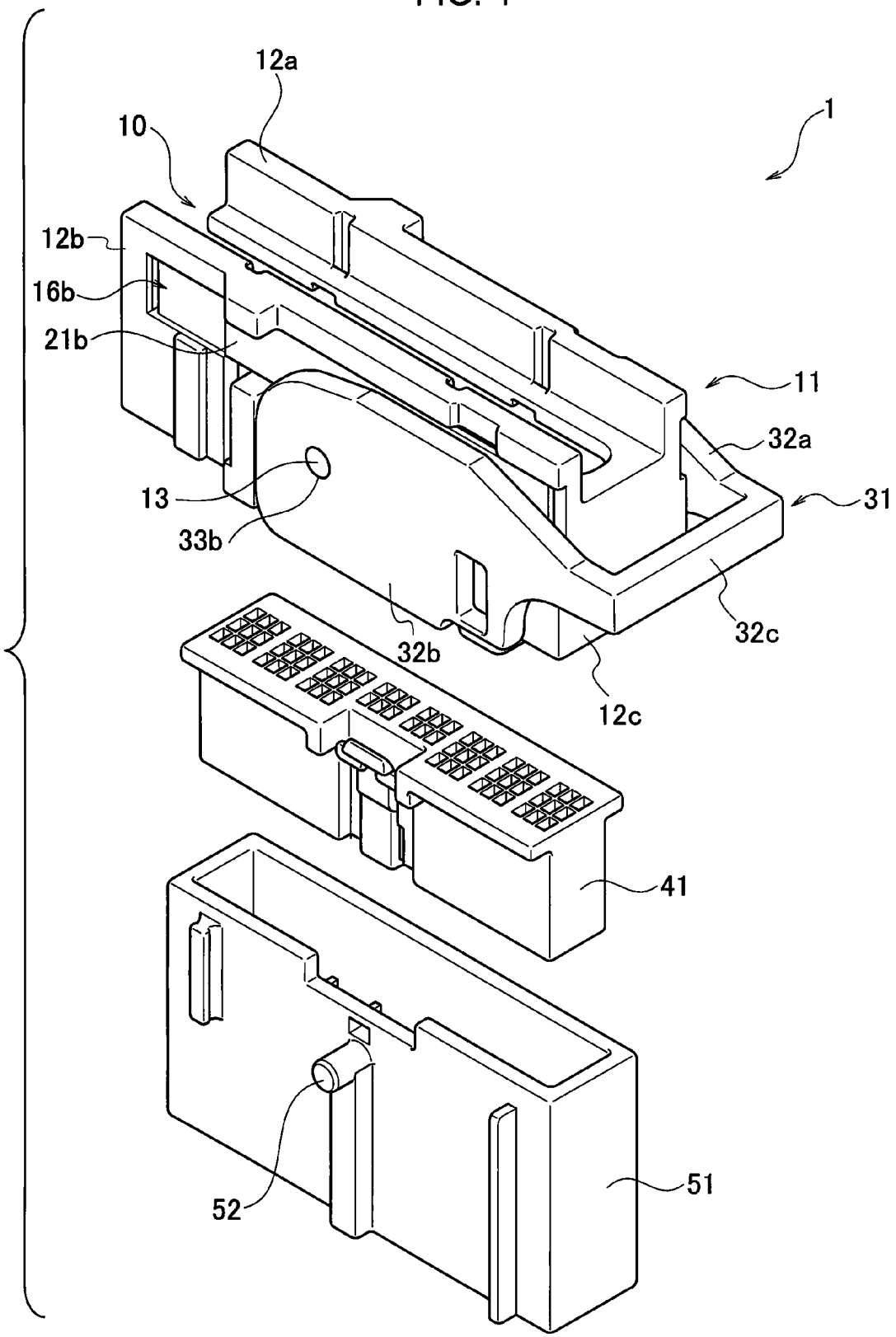
FIG. 4 is a perspective view showing an auxiliary fitting jig and female and male connectors according to an embodiment of the present invention.

Next, a configuration of the auxiliary fitting jig 1 according to the embodiment of the present invention will be described in detail with reference to FIGS. 4 to 7. FIG. 4 is a perspective view showing the auxiliary fitting jig 1 and the female connector 41 according to the embodiment of the invention.

Figure 5:
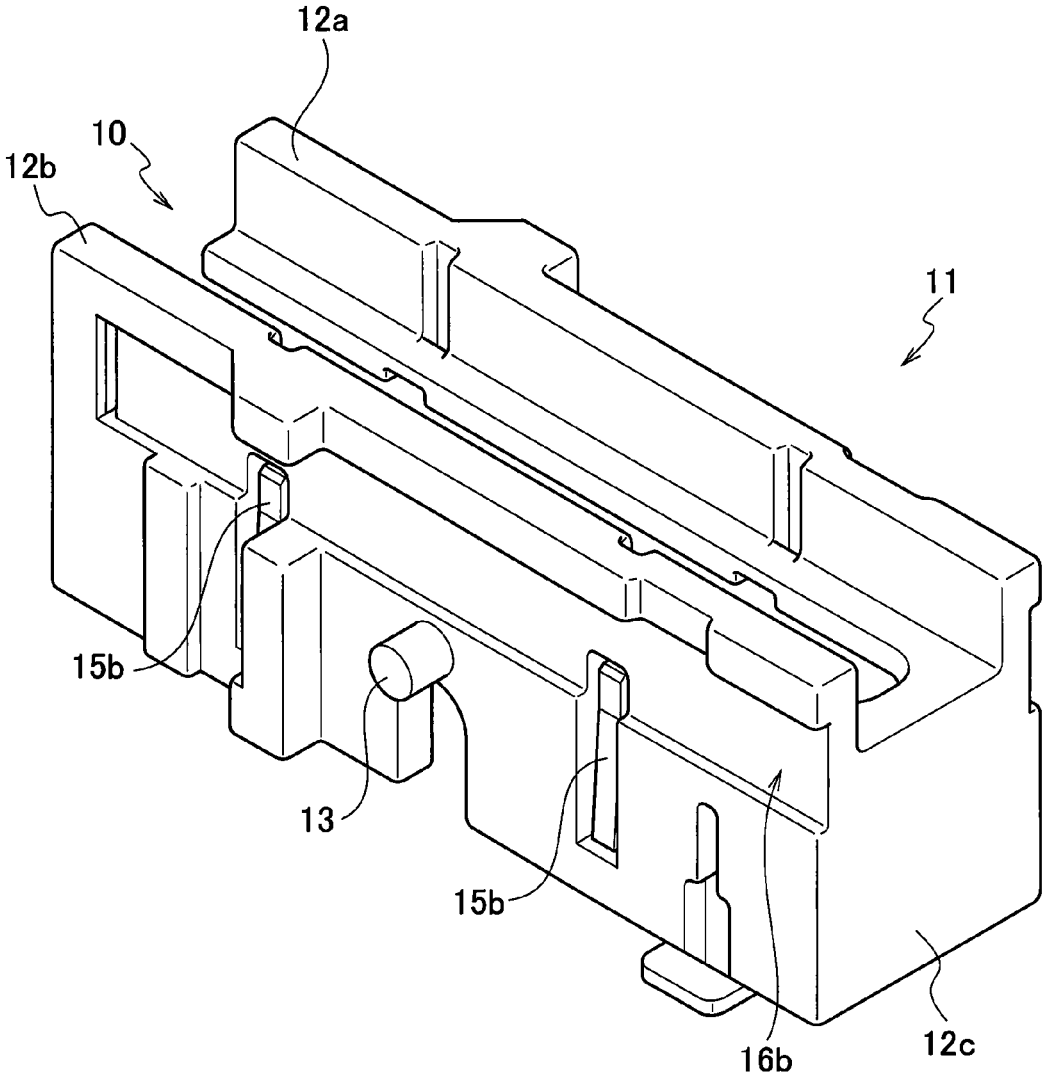
FIG. 5 is a perspective view showing a jig body of the auxiliary fitting jig according to the embodiment of the present invention.
Figure 6:
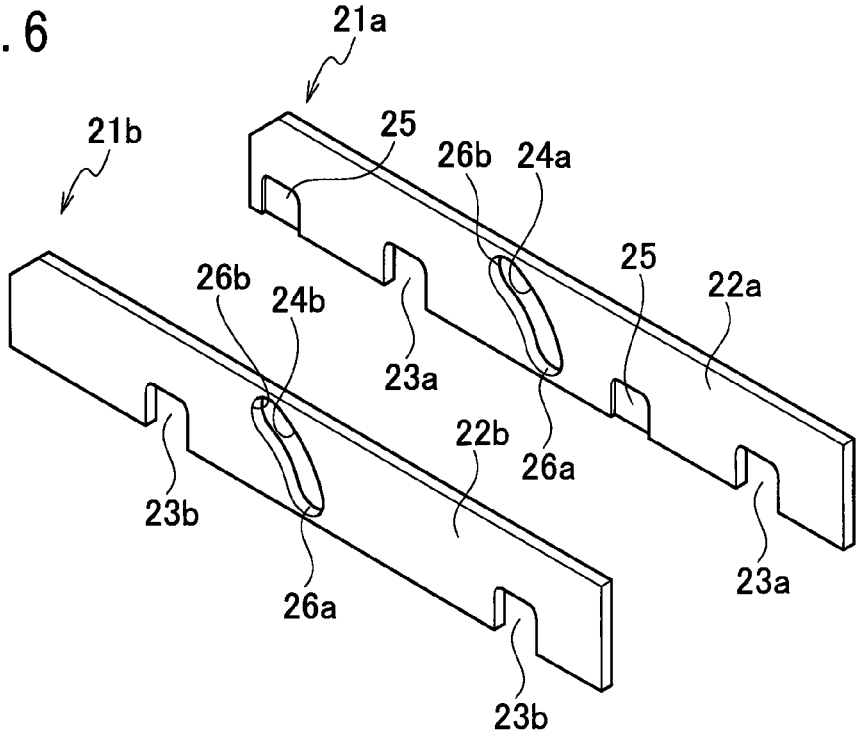
FIG. 6 is a perspective view showing a displacement movement member of the auxiliary fitting jig according to the embodiment of the present invention.
Figure 7:
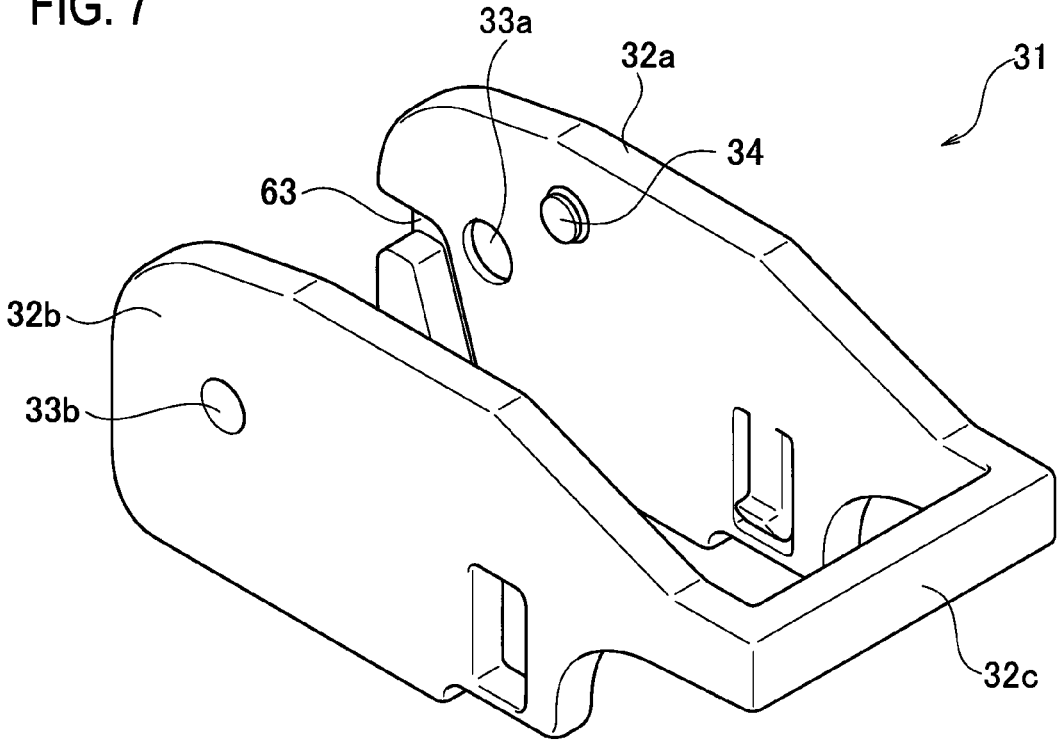
FIG. 7 is a perspective view showing a lever of the auxiliary fitting jig according to the embodiment of the present invention.

FIG. 5 is a perspective view showing the jig body 11 of the auxiliary fitting jig 1 according to the embodiment of the present invention. FIG. 6 is a perspective view showing the displacement movement members 21*a* and 21*b* of the auxiliary fitting jig 1 according to the embodiment of the invention. FIG. 7 is a perspective view showing the lever 31 of the auxiliary fitting jig 1 according to the embodiment of the invention.

The auxiliary fitting jig 1 according to the embodiment of the present invention is used for rotating the lever 31 to fit the male connector 51 with the female connector 41 as in the auxiliary fitting jig 100.

As illustrated in FIGS. 4 to 7, the auxiliary fitting jig 1 according to the embodiment of the present invention is substantially constituted of a jig body 11 having a connector reception chamber 10 receiving the female connector 41, a pair of displacement movement members 21*a* and 21*b* which is in contact with the both side surfaces of the jig body 11 and can displacement move with respect to the jig body 11 according to the rotational angle of the lever 31, and a lever 31 rotatably pivotally supported by the jig body 11.

As illustrated in FIGS. 4 and 5, the jig body 11 has a first jig body 12*a* and a second jig body 12*b* interposing and holding the female connector 41 in between from the both sides of the female connector 41 and a jig body connecting portion 12*c* connecting between the first jig body 12*a* and the second jig body 12*b*.

The first jig body 12*a* and the second jig body 12*b* have a pair of lever attachment bosses 13 (one side is omitted) rotatably pivotally supporting the lever 31, a pair of connector engagement protrusions 14*a* and 14*b* (see, FIG. 10A to be described later) which can be engaged with the female connector 41, and a pair of connector engagement lock portions 15*a* and 15*b* (see, FIG. 10C to be described later) which is bent and deformed in such a state that the engagement with the female connector 41 is released.

The first jig body 12*a* and the second jig body 12*b* have, respectively, slide grooves 16*a* and 16*b* as a pair, which slidably support the displacement movement members 21*a* and 21*b*, respectively.

The lever attachment bosses 13 (one side is omitted) are inserted through jig assembly holes 33*a* and 33*b* to be described later (see, FIG. 7) and rotatably pivotally support the lever 31 with respect to the first and second jig bodies 12*a* and 12*b*.

The connector engagement protrusions 14*a* and 14*b* are projectingly provided toward the connector reception chamber 10 from the both side surfaces of the first and second jig bodies 12*a* and 12*b* and engage with the female connector 41 received in the connector reception chamber 10 (see, FIG. 10A to be described later).

The connector engagement lock portions 15*a* and 15*b* are bent and deformed on the opposite side of the connector reception chamber 10 in such a state that the engagement of the connector engagement protrusions 14*a* and 14*b* to the female connector 41 is released by fitting of the male connector 51 with the female connector 41 received in the connector reception chamber 10.

The slide grooves 16*a* and 16*b* are linearly formed on the both side surfaces of the jig body 11. The slide grooves 16*a* and 16*b* slidably support the displacement movement members 21*a* and 21*b*, respectively, and support the displacement movement members 21*a* and 21*b* throughout a slidable range of the displacement movement members 21*a* and 21*b* sliding according to the rotational angle of the lever 31.

As illustrated in FIG. 6, the plate-shaped displacement movement members 21*a* and 21*b* have deformation preventing portions 22*a* and 22*b*, which are in contact with the connector engagement lock portions 15*a* and 15*b* (see, FIG. 5) and prevent the bending deformation of the connector engagement lock portions 15*a* and 15*b*, and deformation allowing portions 23*a* and 23*b* releasing the connector engagement lock portions 15*a* and 15*b* from the contact and allowing the bending deformation of the connector engagement lock portions 15*a* and 15*b*.

The displacement movement members 21*a* and 21*b* have lever attachment holes (boss attachment holes) 24*a* and 24*b* through which displacement movement member attachment bosses 34 (one side is omitted, see, FIG. 7) of the lever 31, which will be described later, are inserted.

The deformation preventing portions 22*a* and 22*b* prevent the bending deformation of the connector engagement lock portions 15*a* and 15*b* in the process of fitting the male connector 51 with the female connector 41 accompanying the rotation of the lever 31 and releasing the engagement of the connector engagement protrusions 14*a* and 14*b*.

The deformation preventing portions 22*a* and 22*b* each have a lock contact portion 25 with which the connector engagement lock portions 15*a* and 15*b* are in contact before the rotation of the lever 31 to prevent the bending deformation.

The lock contact portions 25 are provided corresponding to the connector engagement lock portions 15*a* and 15*b*. The lock contact portions 25 are in contact with the connector engagement lock portions 15*a* and 15*b* before the rotation of the lever 31, whereby the positions of the displacement movement members 21*a* and 21*b* can be aligned with respect to the slide grooves 16*a* and 16*b*, respectively.

The connector engagement lock portions 15*a* and 15*b* can be engaged with the deformation allowing portions 23*a* and 23*b*. The deformation allowing portions 23*a* and 23*b* are engaged with the connector engagement lock portions 15*a* and 15*b* in the process of fitting the male connector 51 with the female connector 41 accompanying the rotation of the lever 31 and releasing the engagement of the connector engagement protrusions 14*a* and 14*b* to thereby allow the bending deformation of the connector engagement lock portions 15*a* and 15*b*.

The displacement movement member attachment bosses 34 of the lever 31, which will be described later, are inserted into the lever attachment holes (boss attachment holes) 24*a* and 24*b*, and the lever attachment holes 24*a* and 24*b* are formed so that the corresponding displacement movement member attachment bosses 34 are movable according to the rotational range of the lever 31 with respect to the jig body 11.

As described above, since the displacement movement members 21*a* and 21*b* have, respectively, the lever attachment holes 24*a* and 24*b* through which the corresponding displacement movement member attachment bosses 34 are movable according to the rotational range of the lever 31, the displacement movement members 21*a* and 21*b* can be moved accompanying the rotation of the lever 31.

The lever attachment holes 24*a* and 24*b* have such a shape that when the displacement movement member attachment bosses 34 (see, FIG. 7 to be described later) are moved from one end 26*a* to the other end 26*b* by the rotation of the lever 31, the displacement movement members 21*a* and 21*b* can slide in the slide grooves 16*a* and 16*b*.

As illustrated in FIG. 7, the lever 31 has a first lever body 32*a* rotatably pivotally supported by the first jig body 12*a*, a second lever body 32*b* rotatably pivotally supported by the second jig body 12*b*, and a lever body connecting portion 32*c* connecting between the first lever body 32*a* and the second lever body 32*b*.

The first lever body 32*a* and the second lever body 32*b* rotate in planes along the sliding directions (arrow F direction of FIG. 12B to be described later) of the displacement movement members 21*a* and 21*b*, respectively (see, FIGS. 10A to 16 to be described later).

As described above, since a pair of the lever bodies 32*a* and 32*b* rotate in the planes along the sliding directions of the displacement movement members 21*a* and 21*b*, the first lever body 32*a* and the second lever body 32*b* can be directly connected to the displacement movement members 21*a* and 21*b* through the displacement movement member attachment bosses 34. Thus, the bending deformation of the connector engagement lock portions 15*a* and 15*b* can be prevented and allowed with a simple structure.

The first lever body 32*a* and the second lever body 32*b* have a pair of the jig assembly holes 33*a* and 33*b*, a pair of male connector engagement portions 63 engaged with the male connector protrusion 52 (see, FIG. 4, one side is omitted), and the displacement movement member attachment bosses (assembly bosses) 34 (one side is omitted) inserted into the lever attachment holes 24*a* and 24*b* (see, FIG. 6).

The paired lever attachment bosses 13 (see, FIG. 5, one side is omitted) of the first jig body 12*a* and the second jig body 12*b* are inserted into the jig assembly holes 33*a* and 33*b* as a pair, respectively.

A pair of the male connector engagement portions 63 (one side is omitted) is engaged with a pair of the male connector protrusions 52 (see, FIG. 4, one side is omitted) projectingly provided outside the male connector 51.

The male connector engagement portion 63 has one side 63*a* and the other side 63*c* opened at two points of end surfaces of the first lever body 32*a* and the second lever body 32*b*. A portion between the one side 63*a* and the other side 63*c* is connected through an intermediate portion 63*b* whose distance from the jig assembly holes 33*a* and 33*b* gradually reduces (see, FIG. 10E to be described later).

The paired displacement movement member attachment bosses (assembly bosses) 34 (one side is omitted) are inserted through the lever attachment holes 24*a* and 24*b* (see, FIG. 6) of the displacement movement member 21*a* and 21*b*, and when the lever 31 is rotated, the displacement movement member attachment bosses 34 move in the lever attachment holes 24*a* and 24*b* according to the rotational range of the lever 31.

Figure 8:
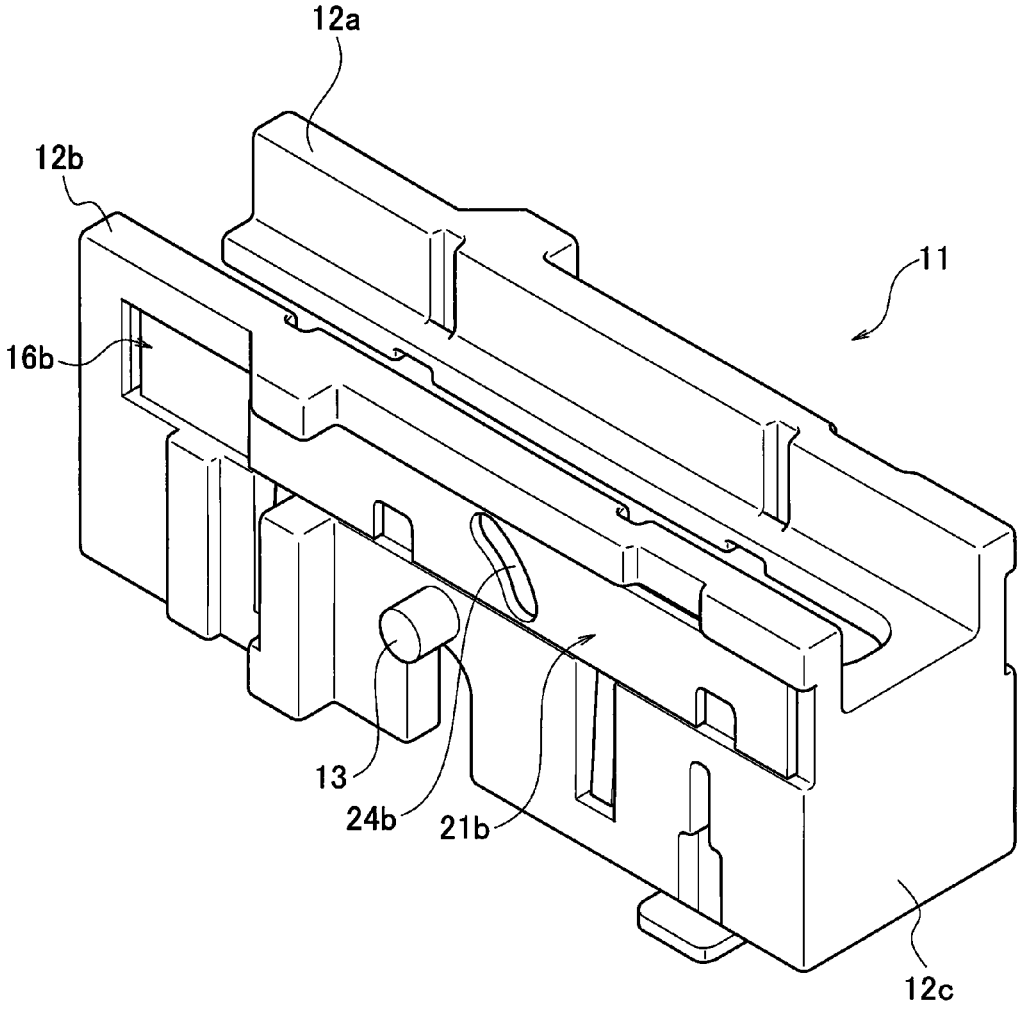
FIG. 8 is a perspective view showing the jig body supporting a displacement movement member according to the embodiment of the present invention.
Figure 9:
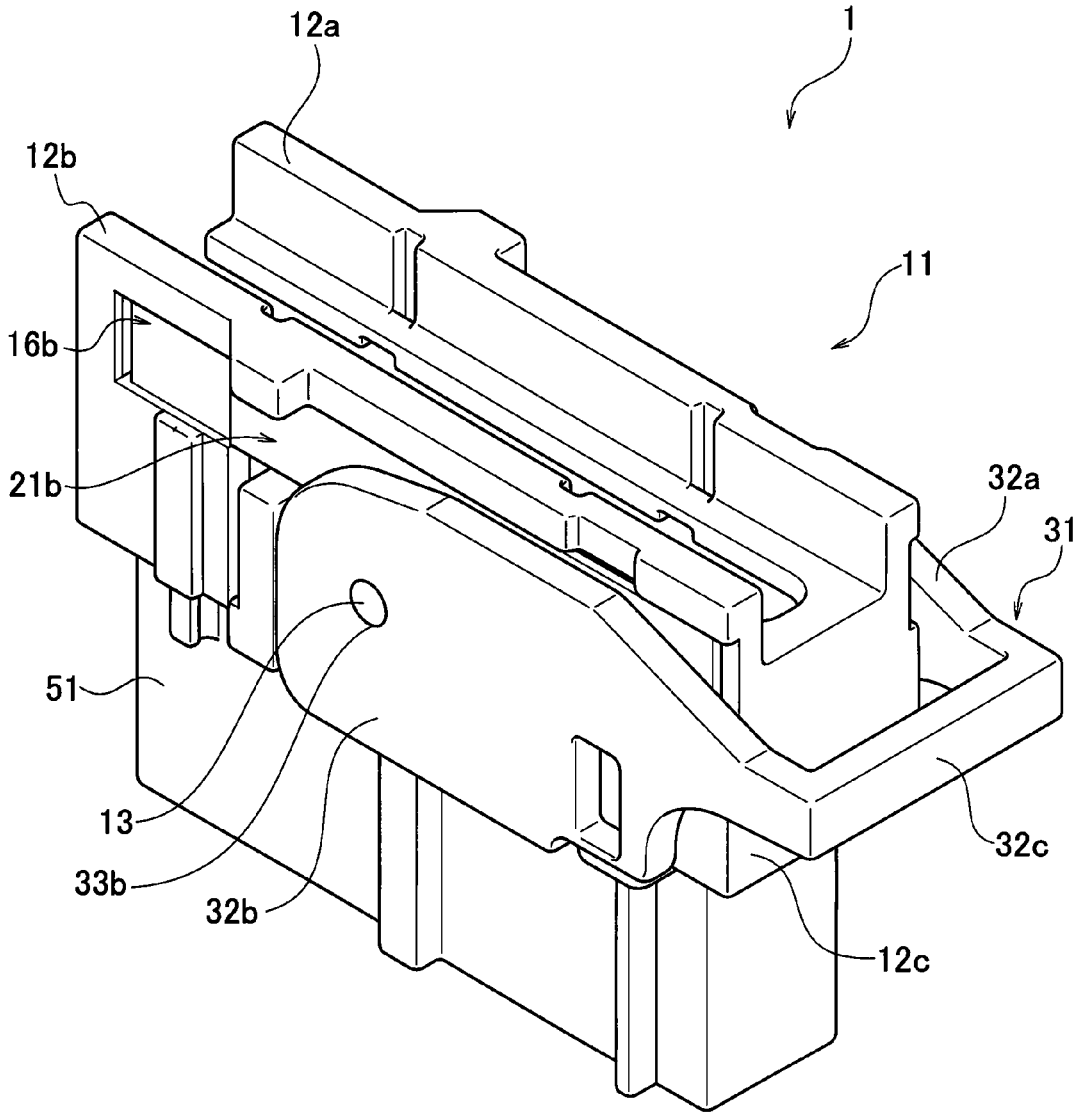
FIG. 9 is a perspective view showing the auxiliary fitting jig according to the embodiment of the present invention.

Next, the assembly between the jig body 11 and the lever 31 according to the embodiment of the present invention will be described with reference to FIGS. 8 and 9. FIG. 8 is a perspective view showing the auxiliary fitting jig 1 according to the embodiment of the invention. FIG. 9 is a perspective view showing the jig body 11 pivotally supporting the lever 31 according to the embodiment of the invention.

As illustrated in FIG. 8, the displacement movement members 21*a* and 21*b* are in contact with the slide grooves 16*a* and 16*b* formed on the respective side surfaces of the first and second jig bodies 12*a* and 12*b*, whereby the jig body 11 supports the displacement movement members 21*a* and 21*b*.

When the displacement movement members 21*a* and 21*b* are supported by the jig body 11, the connector engagement lock portions 15*a* and 15*b* (see, FIG. 5) are in contact with the lock contact portion 25 (see, FIG. 6) to align the positions of the displacement movement members 21*a* and 21*b* with respect to the slide grooves 16*a* and 16*b*.

As illustrated in FIG. 9, the lever attachment bosses 13 (see, FIG. 8, one side is omitted) are attached to the jig assembly holes 33*a* and 33*b* of the jig body 11 supporting the displacement movement members 21*a* and 21*b*, whereby the lever 31 is rotatably pivotally supported by the jig body 11.

In the auxiliary fitting jig 1 in which the lever 31 is rotatably pivotally supported by the jig body 11, the female connector 41 (see, FIG. 4) is received in the connector reception chamber 10, and the female connector 41 is inserted into the male connector 51. The lever 31 is then rotated to fit the male connector 51 with the female connector 41.

Figure 11:
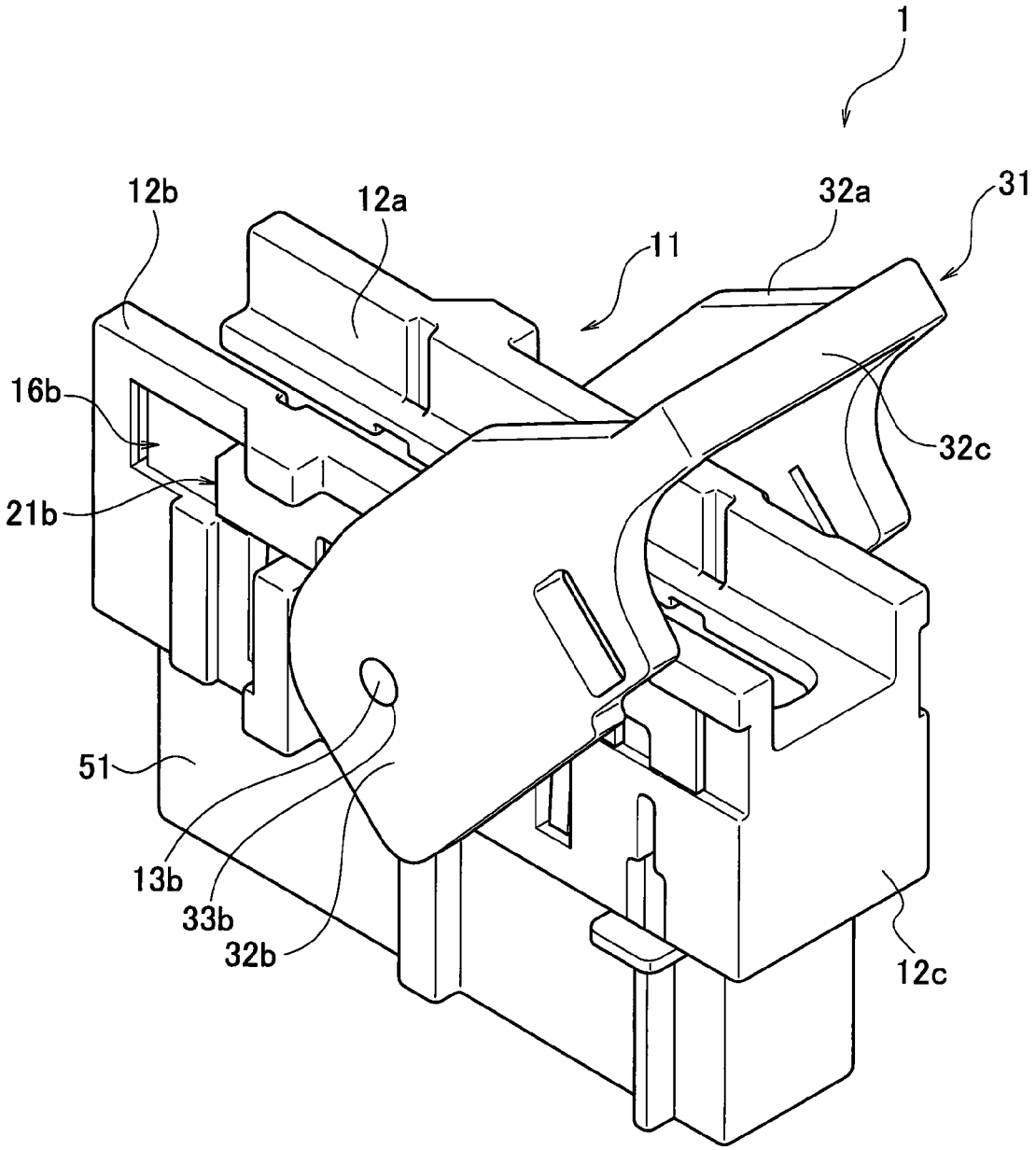
FIG. 11 is a perspective view showing a state during the rotation of the lever of the auxiliary fitting jig according to the embodiment of the present invention.
Figure 12A:
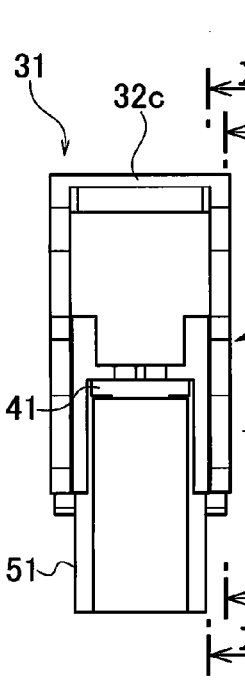
FIGS. 12A to 12E are views each showing the state during the rotation of the lever of the auxiliary fitting jig according to the embodiment of the present invention.
Figure 12B:
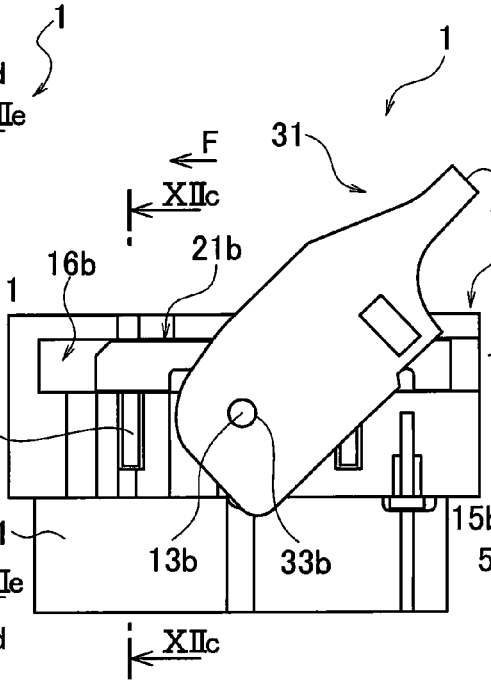
Figure 12C:
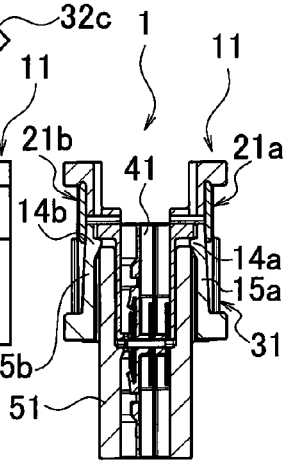
Figure 12D:
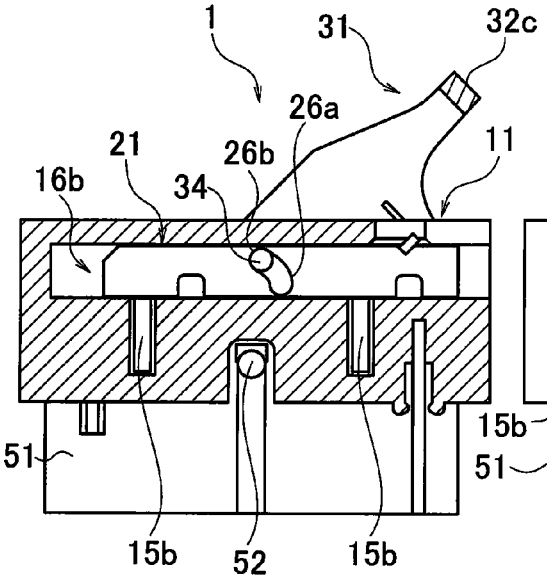
Figure 12E:
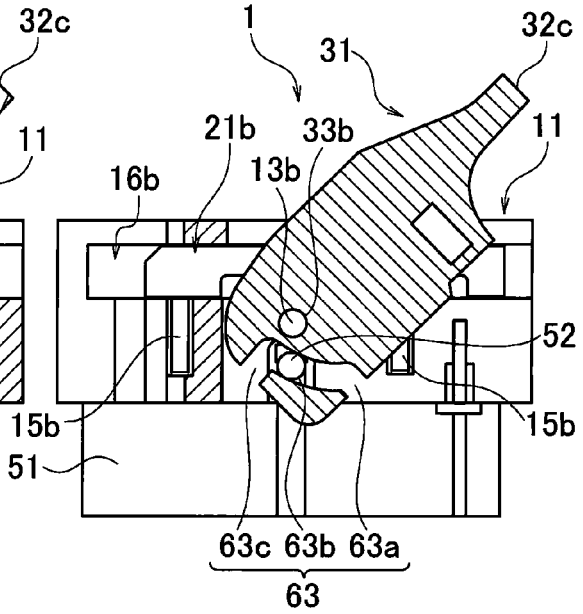
Figure 13:
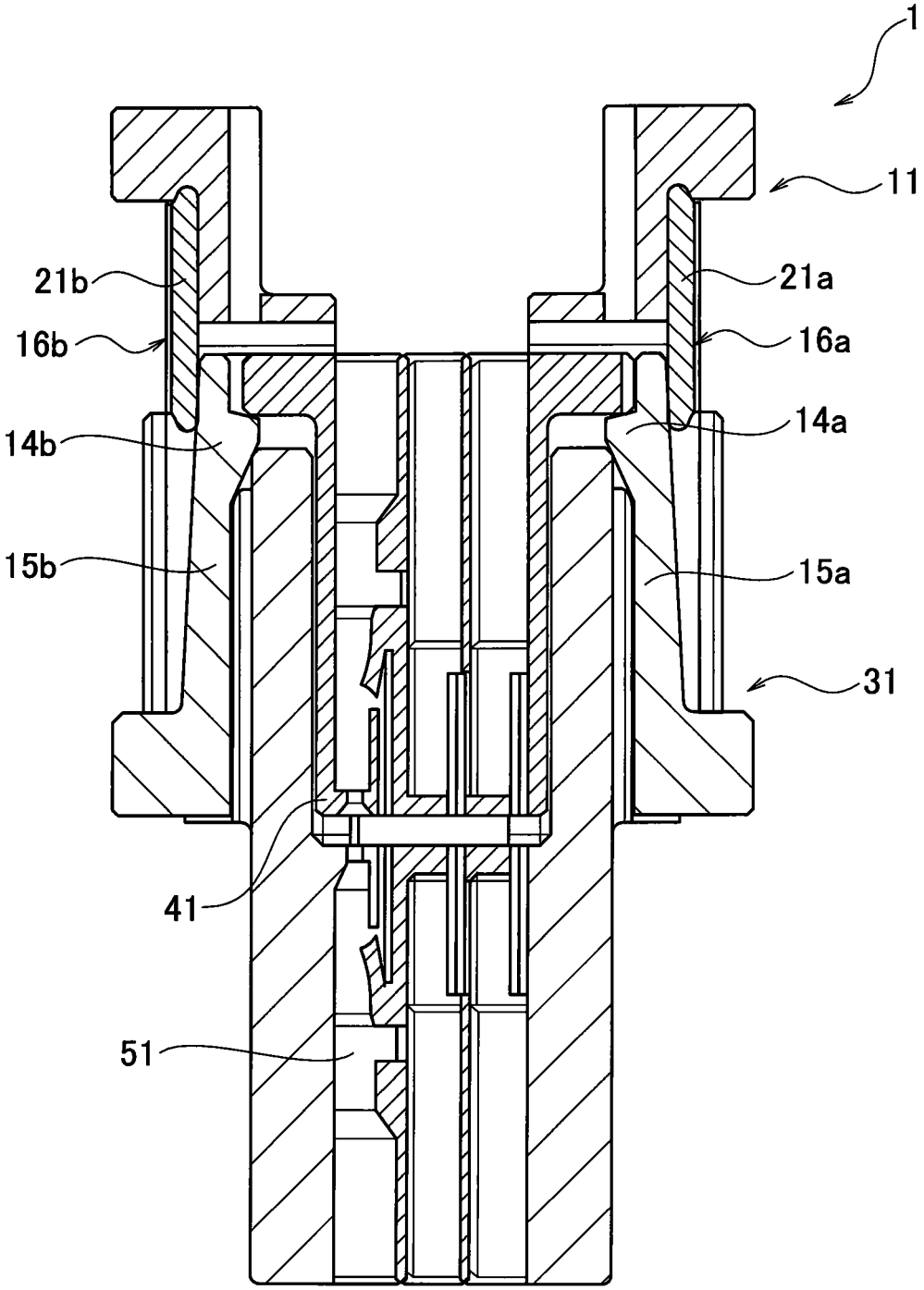
FIG. 13 is a cross-sectional view showing the state during the rotation of the lever of the auxiliary fitting jig according to the embodiment of the present invention.

Next, the fitting operation of the auxiliary fitting jig 1 according to the embodiment of the present invention will be described with reference to FIGS. 10A to 16. FIGS. 10A and 10B are front views and FIGS. 10C to 10E are cross-sectional views showing a state before the rotation of the lever 31 of the auxiliary fitting jig 1 according to the embodiment of the invention. FIG. 11 is a perspective view showing a state during the rotation of the lever 31 of the auxiliary fitting jig 1 according to the embodiment of the invention. FIGS. 12A and 12B are front views and FIGS. 12C to 12E are cross-sectional views showing the state during the rotation of the lever 31 of the auxiliary fitting jig 1 according to the embodiment of the invention. FIG. 13 is a cross-sectional view showing the state during the rotation of the lever 31 of the auxiliary fitting jig 1 according to the embodiment of the invention.

Figure 14:
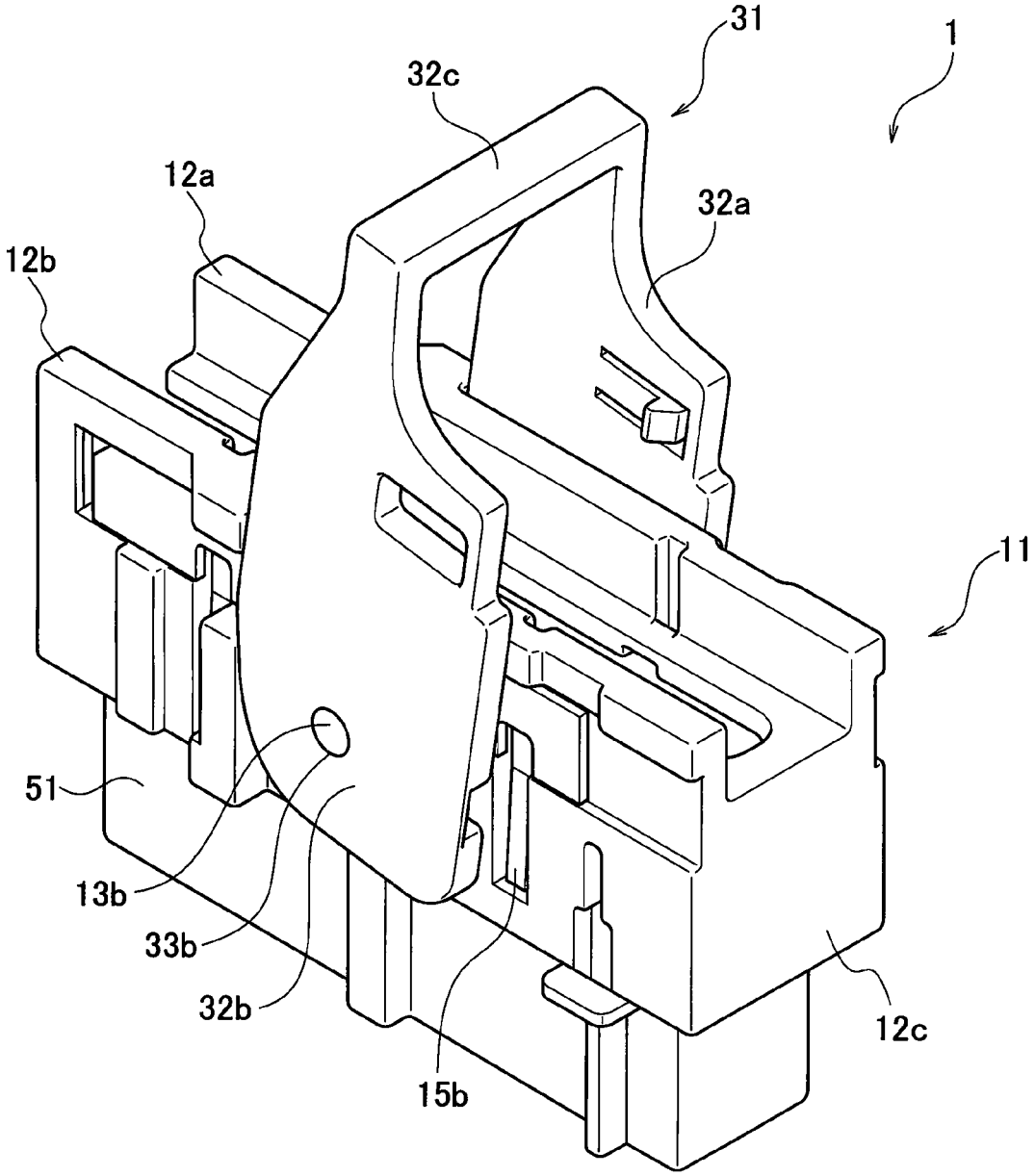
FIG. 14 is a perspective view showing a state after the rotation of the lever of the auxiliary fitting jig according to the embodiment of the present invention.
Figure 15A:
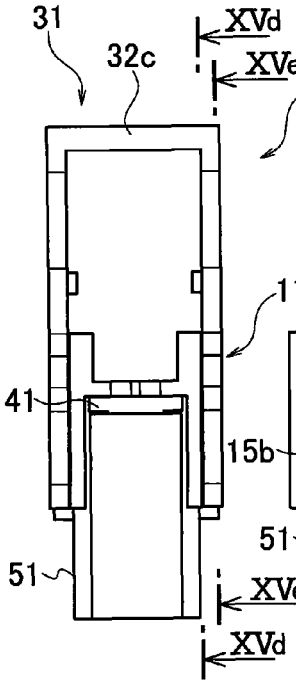
FIGS. 15A to 15E are views each showing the state after the rotation of the lever of the auxiliary fitting jig according to the embodiment of the present invention.
Figure 15B:
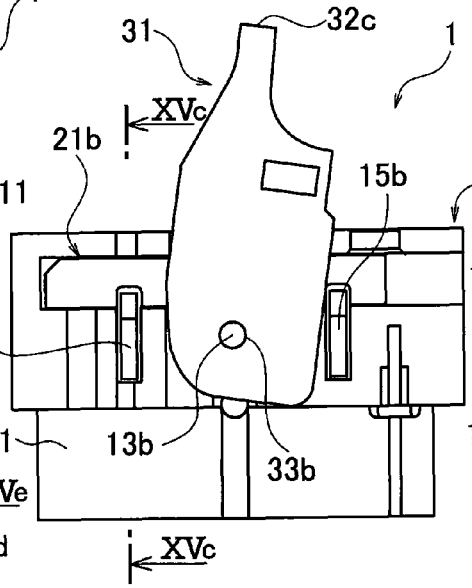
Figure 15C:
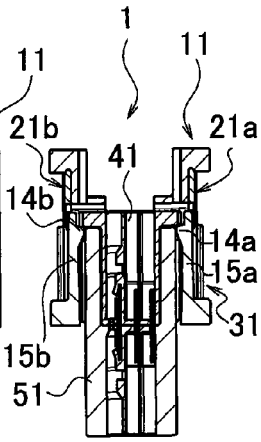
Figure 15D:
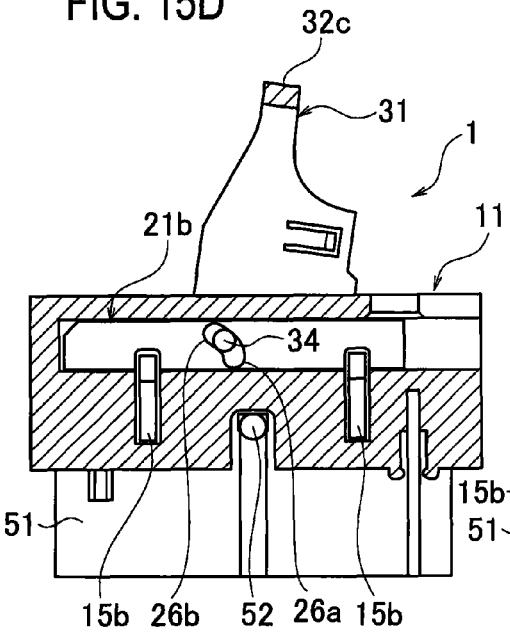
Figure 15E:
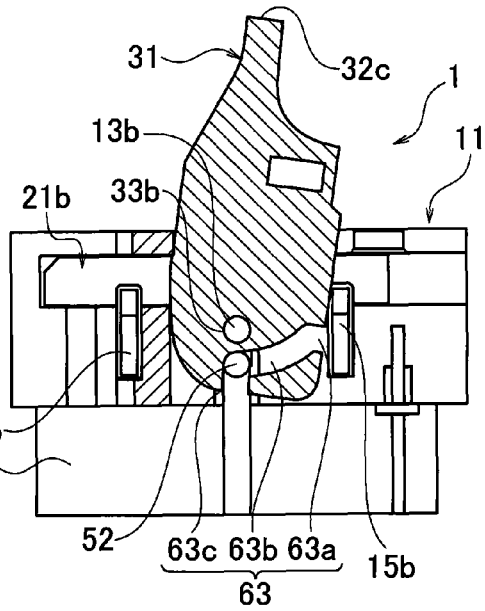
Figure 16:
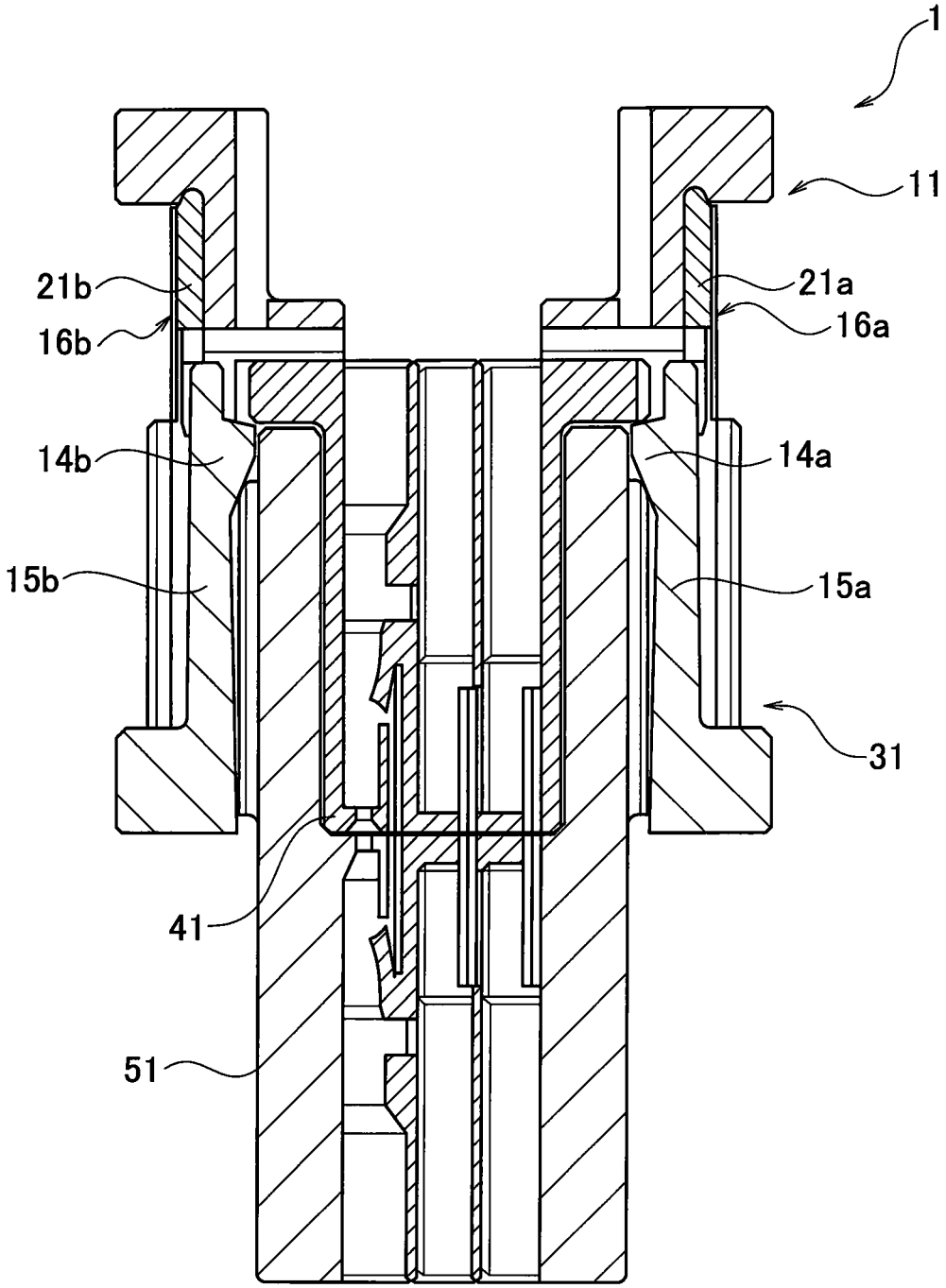
FIG. 16 is a cross-sectional view showing the state after the rotation of the lever of the auxiliary fitting jig according to the embodiment of the present invention.

FIG. 14 is a perspective view showing a state after the rotation of the lever 31 of the auxiliary fitting jig 1 according to the embodiment of the present invention. FIGS. 15A and 15B are front views and FIGS. 15C to 15E are cross-sectional views showing the state after the rotation of the lever 31 of the auxiliary fitting jig 1 according to the embodiment of the invention. FIG. 16 is a cross-sectional view showing the state after the rotation of the lever 31 of the auxiliary fitting jig 1 according to the embodiment of the present invention.

As illustrated in FIGS. 10A to 10E, the paired displacement movement members 21*a* and 21*b* are in contact with the both side surfaces of the jig body 11. In this case, the connector engagement lock portions 15*a* and 15*b* (see, FIG. 5) are in contact with the lock contact portion 25 (see, FIG. 6), and the positions of the displacement movement members 21*a* and 21*b* are aligned with respect to the slide grooves 16*a* and 16*b* (see, FIGS. 6 and 8).

Next, the lever attachment bosses 13 (one side is omitted) are inserted into the jig assembly holes 33*a* and 33*b*, and the displacement movement member attachment bosses 34 are inserted into the lever attachment holes 24*a* and 24*b* (see, FIGS. 6 and 7), so that the lever 31 is rotatably pivotally attached to the jig body 11.

Figures 10A, 10B, 10C, 10D, 10E:
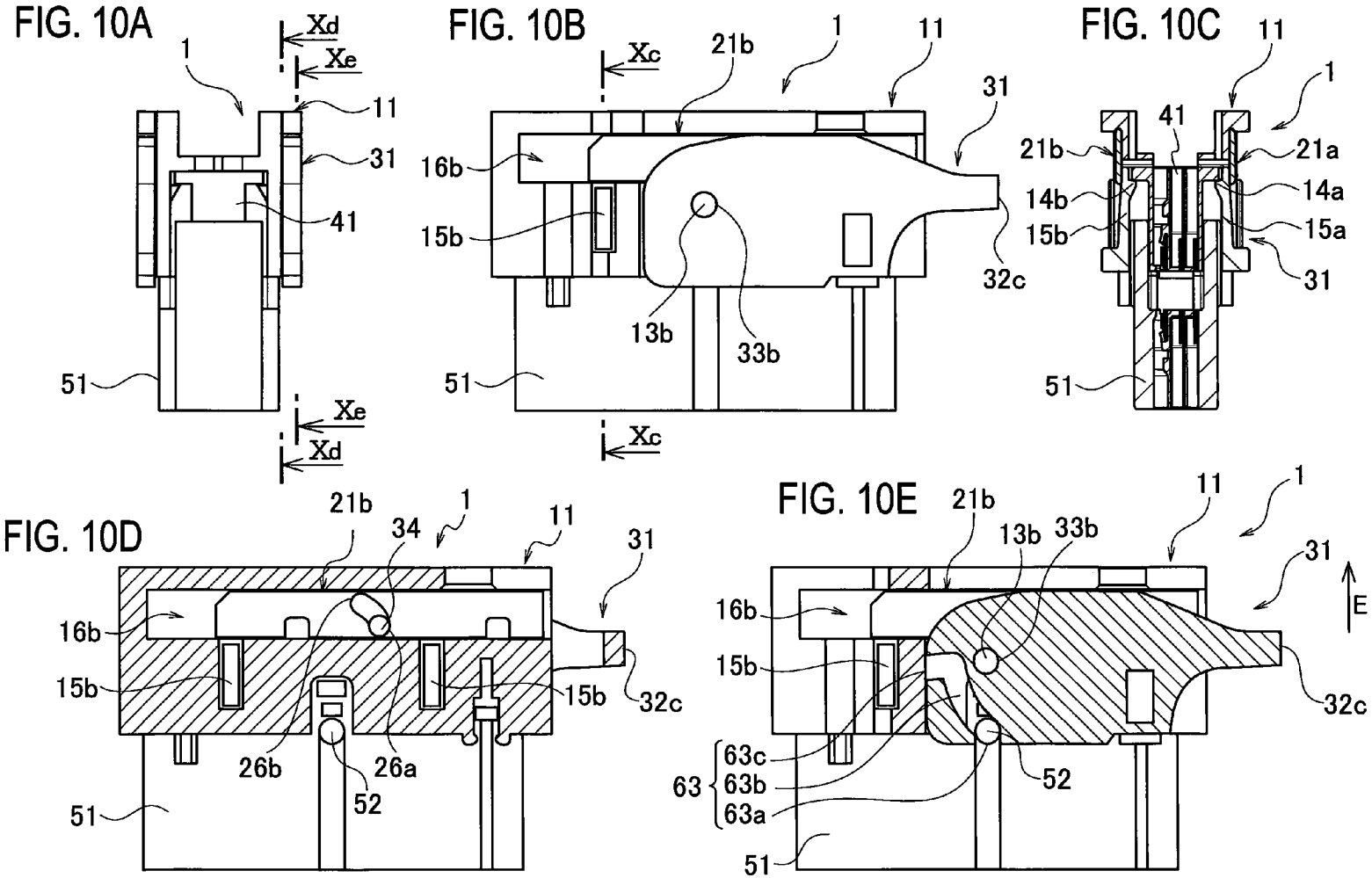
FIGS. 10A to 10E are views each showing a state before rotation of the lever of the auxiliary fitting jig according to the embodiment of the present invention.

When the lever is attached to the jig body 11, the displacement movement member attachment boss 34 is inserted into the end 26*a* of each of the lever attachment holes 24*a* and 24*b* (see, FIG. 10D).

Next, the female connector 41 is received in the connector reception chamber 10 of the jig body 11 to be inserted into the male connector 51. When the auxiliary fitting jig 1 is inserted into the male connector 51, the connector engagement protrusions 14*a* and 14*b* engage with the female connector 41.

When the auxiliary fitting jig 1 is inserted into the male connector 51, the male connector engagement portions 63 (one side is omitted) of the lever 31 are engaged with a pair of the mail connector protrusions 52.

In such a state that the auxiliary fitting jig 1 is inserted into the male connector 51 (the state before the 0rotation of the lever in the arrow E direction), the one side 63*a* of the male connector engagement portion 63 is engaged with the male connector protrusion 52 (see, FIG. 10E).

Next, as illustrated in FIGS. 11 to 13, the lever body connecting portion 32*c* of the lever 31 is rotated upward (the arrow E direction of FIG. 10E), in such a state that the lever 31 is partially rotated (the state of the lever illustrated in FIGS. 11 to 13), the intermediate portion 63*b* of the male connector engagement portion 63 is engaged with the male connector protrusion 52 (see, FIG. 12E).

As described above, when a portion of the male connector engagement portion 63 with which the male connector protrusion 52 engages moves from the side 63*a* to the intermediate portion 63*b*, a distance between the jig assembly holes 33*a* and 33*b* as the rotational center of the lever 31 and the male connector protrusion 152 is reduced.

Consequently, an interval between lever attachment bosses 13*a* and 13*b* of the jig body 11 receiving the female connector 41 and the male connector protrusion 52 is reduced corresponding to the rotational angle of the lever 31, whereby the male connector 51 moves toward the female connector 41 (see, FIGS. 11 to 13).

When the male connector 51 moves toward the female connector 41, the displacement movement member attachment boss 34 moves from the end 26*a* to the end 26*b* of each of the lever attachment holes 24*a* and 24*b*, and therefore, the displacement movement members 21*a* and 21*b* move in the arrow F direction illustrated in FIG. 12B.

When the male connector 51 moves toward the female connector 41, the connector engagement protrusions 14*a* and 14*b* are in contact with the male connector 51, the connector engagement lock portions 15*a* and 15*b* are bent and deformed on the opposite side of the connector reception chamber 10 (see, FIG. 5), and the engagement with the female connector 141 is to be released.

However, since the upper portions of the connector engagement lock portions 15*a* and 15*b* (the opposite side of the male and female connectors 41 and 51) are in contact with the deformation preventing portions 22*a* and 22*b* of the displacement movement members 21*a* and 21*b*, the bending deformation is prevented (see, FIG. 13). Thus, the release of the engagement of the connector engagement protrusions 14*a* and 14*b* with respect to the female connector 41 are prevented by the deformation preventing portions 22*a* and 22*b*.

As illustrated in FIGS. 14 to 16, in the state in which the lever 31 completely rotates (the state of the lever illustrated in FIGS. 14 to 16), the other side 63*c* of the male connector engagement portion 63 is engaged with the male connector protrusion 52, and the male connector 51 fits the female connector 41 (see, FIG. 10E).

When the male connector 51 fits the female connector 41, the displacement movement members 21*a* and 21*b* move in the arrow F direction illustrated in FIG. 12B, and the deformation allowing portions 23*a* and 23*b* engage with the connector engagement lock portions 15*a* and 15*b*.

When the deformation allowing portions 23*a* and 23*b* engage with the connector engagement lock portions 15*a* and 15*b*, the bending deformation of the connector engagement lock portions 15*a* and 15*b* is allowed, and therefore, the engagement of the connector engagement protrusions 14*a* and 14*b* to the female connector 41 is released.

As described above, in the process of fitting the male connector 51 with the female connector 41 received in the connector reception chamber 10 accompanying the rotation of the lever 31 and releasing the engagement of the connector engagement protrusions 14*a* and 14*b* to the female connector 41, the displacement movement members 21*a* and 21*b* move in synchronism with the lever 31 from the position where the bending deformation of the connector engagement lock portions 15*a* and 15*b* is prevented by the deformation preventing portions 22*a* and 22*b* to the position where the bending deformation is allowed by the deformation allowing portions 23*a* and 23*b*.

When the engagement with the female connector 41 is released, the first jig body 112*a* and the second jig body 112*b* extend toward the first lever body 132*a* or the second lever body 132*b*, and therefore, the auxiliary fitting jig 1 can be released from the female connector 41.

As described above, in the process of fitting the male connector 51 with the female connector 41 and releasing the engagement of the connector engagement protrusions 14*a* and 14*b* to the female connector, the displacement movement members 21*a* and 21*b* move in synchronism with the lever 31 from the position where the bending deformation of the connector engagement lock portions 15*a* and 15*b* is prevented by the deformation preventing portions 22*a* and 22*b* to the position where the bending deformation is allowed by the deformation allowing portions 23*a* and 23*b*.

Thus, in the process of rotating the lever 31 to fit the male connector 51 with the female connector 41, the deformation preventing portions 22*a* and 22*b* prevent the bending deformation of the connector engagement lock portions 15*a* and 15*b* to prevent the removal of the auxiliary fitting jig 1.

When the male connector 51 fits the female connector 41, the deformation allowing portions 23*a* and 23*b* allow the bending deformation of the connector engagement lock portions 15*a* and 15*b*, and therefore, the auxiliary fitting jig 1 is removed from the female and male connectors 41 and 51 and then can be used for fitting other connectors.

Accordingly, an auxiliary fitting jig having improved fitting operation accuracy and a high versatility can be provided.

When the male connector 51 fits the female connector 41, the other side 63*c* of the male connector engagement portion 63 is linearly located upward (in the arrow E direction illustrated in FIG. 10E) (see, FIG. 15E).

Thus, the lever 31 and the jig body 11 are moved upward (in the arrow E direction illustrated in FIG. 10E), whereby the auxiliary fitting jig 1 can be easily removed from the female connector 41 fitting the male connector 51.

As described above, the auxiliary fitting jig 1 according to the embodiment of the present invention is used for rotating the lever 31 to fit one connector with the other connector and provided with the jig body 11 having the connector reception chamber 10 receiving the other connector and a pair of the displacement movement members 21*a* and 21*b* which can displacement move with respect to the both side surface of the jig body 11 according to the rotational angle of the lever 31. The jig body 11 has a pair of the connector engagement protrusions 14*a* and 14*b* which are provided on the both side surfaces of the jig body 11 and can be engaged with one connector received in the connector reception chamber 10 and a pair of the connector engagement lock portions 15*a* and 15*b* which is bent and deformed on the opposite side of the connector reception chamber 10 in such a state that the engagement of the connector engagement protrusions 14*a* and 14*b* to the connector received in the connector reception chamber 10 is released by fitting of the connector with the other connector. The displacement movement members 21*a* and 21*b* have, respectively, the deformation preventing portions 22*a* and 22*b*, which are in contact with the connector engagement lock portions 15*a* and 15*b* to prevent the bending deformation of the connector engagement lock portions 15*a* and 15*b*, and the deformation allowing portions 23*a* and 23*b* releasing the connector engagement lock portions 15*a* and 15*b* from the contact and allowing the bending deformation of the connector engagement lock portions 15*a* and 15*b*. In the process of fitting one connector with the other connector received in the connector reception chamber 10 accompanying the rotation of the lever 31 and releasing the engagement of one of the connector engagement protrusions 14*a* and 14*b* to the other connector, the displacement movement members 21*a* and 21*b* move in synchronism with the lever 31 from the position where the bending deformation of the connector engagement lock portions 15*a* and 15*b* is prevented by the deformation preventing portions 22*a* and 22*b* to the position where the bending deformation is allowed by the deformation allowing portions 23*a* and 23*b*.

In the auxiliary fitting jig 1 according to the embodiment of the present invention, the jig body 11 has the paired slide grooves 16*a* and 16*b* slidably supporting the displacement movement members 21*a* and 21*b*, respectively, and the lever 31 has the paired lever bodies 32*a* and 32*b* rotating in planes along the sliding directions of the displacement movement members 21*a* and 21*b*.

In the auxiliary fitting jig 1 according to the embodiment of the present invention, the lever 31 has a pair of the assembly bosses (displacement movement member attachment bosses) 34 on which the displacement movement members 21*a* and 21*b* are assembled, and the displacement movement members 21*a* and 21*b* have, respectively, the boss attachment holes (lever attachment holes) 24*a* and 24*b* through which the corresponding assembly bosses 34 are movable according to the rotational range of the lever 31 with respect to the jig body 11.

According to the auxiliary fitting jig 1 according to the embodiment of the present invention, in the process of fitting the male connector 51 with the female connector 41 and releasing the engagement of the connector engagement protrusions 14*a* and 14*b* to the female connector, the displacement movement members 21*a* and 21*b* move in synchronism with the lever 31 from the position where the bending deformation of the connector engagement lock portions 15*a* and 15*b* is prevented by the deformation preventing portions 22*a* and 22*b* to the position where the bending deformation is allowed by the deformation allowing portions 23*a* and 23*b*.

Thus, in the process of rotating the lever 31 to fit the male connector 51 with the female connector 41, the deformation preventing portions 22*a* and 22*b* prevent the bending deformation of the connector engagement lock portions 15*a* and 15*b* to prevent the removal of the auxiliary fitting jig 1.

When the male connector 51 fits the female connector 41, the deformation allowing portions 23*a* and 23*b* allow the bending deformation of the connector engagement lock portions 15*a* and 15*b*, and therefore, the auxiliary fitting jig 1 is removed from the female and male connectors 41 and 51 and then can be used for fitting other connectors.

Accordingly, the auxiliary fitting jig 1 having improved fitting operation accuracy and a high versatility can be provided.

According to the auxiliary fitting jig 1 according to the embodiment of the present invention, since the paired lever bodies 32*a* and 32*b* rotate in the plane along the sliding directions of the displacement movement members 21*a* and 21*b*, the bending deformation of the connector engagement lock portions 15*a* and 15*b* can be prevented and allowed with a simple structure.

According to the auxiliary fitting jig 1 according to the embodiment of the present invention, since the displacement movement members 21*a* and 21*b* have, respectively, the lever attachment holes 24*a* and 24*b* through which the corresponding displacement member attachment bosses 34 are movable according to the rotational range of the lever 31, the displacement movement members 21*a* and 21*b* can be moved accompanying the rotation of the lever 31.

Hereinabove, although the auxiliary fitting jig of the present invention has been described based on the illustrated embodiment, the present invention is not limited thereto, and the constitution of each part may be replaced with any constitution that provides a similar function.

For example, although the displacement movement members 21*a* and 21*b* of the auxiliary fitting jig 1 according to the embodiment of the present invention each have a plate shape, the shape is not limited to the plate shape. Namely, each shape of the displacement movement members 21*a* and 21*b* may be suitably changed as long as the displacement movement members 21*a* and 21*b* have a portion which prevents or allows the bending deformation of the connector engagement lock portions 15*a* and 15*b* accompanying the rotation of the lever 31.

What is claimed is:

1. An auxiliary fitting jig used to fit one connector with an another connector, the auxiliary fitting jig comprising:

a lever;

a jig body having a connector reception chamber configured to receive the one connector, a pair of connector engagement protrusions provided on both side surfaces of the jig body and being engageable with the one connector received in the connector reception chamber, and a pair of connector engagement lock portions configured to be bent and deformed in a direction opposite to the connector reception chamber with an engagement of the connector engagement protrusions with the one connector being released by fitting of the one connector received in the connector reception chamber with the another connector; and a pair of displacement movement members movable to be displaced with respect to the both side surfaces according to a rotational angle of the lever, the pair of displacement movement members having deformation preventing portions configured to be in contact with the connector engagement lock portions to prevent bending deformation of the connector engagement lock portions, and deformation allowing portions configure to release the connector engagement lock portions from the contact to allow the bending deformation of the connector engagement lock portions, wherein in a process of fitting the one connector received in the connector reception chamber with the another connector along with a rotation of the lever and of releasing the engagement of the pair of connector engagement protrusions with the one connector, the pair of displacement movement members are configured to move in synchronism with the lever from a position where the bending deformation of the pair of connector engagement lock portions is prevented by the deformation preventing portions to a position where the bending deformation is allowed by the deformation allowing portions.

2. The auxiliary fitting jig according to claim 1, wherein the jig body has a pair of slide grooves slidably supporting the pair of displacement movement members respectively, and wherein the lever has a pair of lever bodies configured to rotate in a plane along a sliding direction of the pair of displacement movement members.

3. The auxiliary fitting jig according to claim 1, wherein the lever has a pair of assembly bosses for the pair of displacement movement members to be assembled on the pair of assembly bosses, and wherein each of the pair of displacement movement members has a boss attachment hole for the corresponding assembly boss to be movable in the boss attachment hole according to a rotational range of the lever with respect to the jig body.

4. The auxiliary fitting jig according to claim 2, wherein the lever has a pair of assembly bosses for the pair of displacement movement members to be assembled on the pair of assembly bosses, and wherein each of the pair of displacement movement members has a boss attachment hole for the corresponding assembly boss to be movable in the boss attachment hole according to a rotational range of the lever with respect to the jig body.

* * * * *